United States Patent [19]

Andreasson

[11] Patent Number: 4,628,188

[45] Date of Patent: Dec. 9, 1986

[54] ELECTRIC HEATING PAD FOR SEATS AND BACK-RESTS

[75] Inventor: Jan Andreasson, Mullsjö , Sweden

[73] Assignee: AB Mekania-Verken, Mullsjo, Sweden

[21] Appl. No.: 692,888

[22] PCT Filed: Apr. 19, 1984

[86] PCT No.: PCT/SE84/00150

§ 371 Date: Dec. 20, 1984

§ 102(e) Date: Dec. 20, 1984

[87] PCT Pub. No.: WO84/04440

PCT Pub. Date: Nov. 8, 1984

[30] Foreign Application Priority Data

May 4, 1983 [SE] Sweden ..... 8302536

[51] Int. Cl.[4] ..... H05B 3/34

[52] U.S. Cl. ..... 219/528; 219/217; 219/202; 219/549

[58] Field of Search ..... 219/211, 212, 217, 527, 219/528, 529, 545, 549, 200, 201, 202; 338/217, 218

[56] References Cited

U.S. PATENT DOCUMENTS

| | | | |
|---|---|---|---|
| 2,318,109 | 5/1943 | Schultz | 219/524 |
| 2,698,893 | 1/1955 | Ballard | 219/217 |
| 2,802,091 | 8/1957 | MacKendrick | 219/549 |
| 3,013,141 | 12/1961 | Ellis | 219/524 |
| 3,017,493 | 1/1962 | Cooke | 219/217 |
| 3,130,289 | 4/1964 | Katzman et al. | 219/528 X |
| 3,912,905 | 10/1975 | Giler | 338/218 X |
| 4,063,069 | 12/1977 | Peeri | 219/217 X |
| 4,162,393 | 7/1979 | Balboni | 219/217 |
| 4,211,204 | 7/1980 | Glanner et al. | 123/145 A |
| 4,423,309 | 12/1983 | Murphy et al. | 219/270 |

FOREIGN PATENT DOCUMENTS

| | | | |
|---|---|---|---|
| 52509 | 12/1966 | German Democratic Rep. | 219/217 |

*Primary Examiner*—E. A. Goldberg
*Assistant Examiner*—Teresa J. Walberg
*Attorney, Agent, or Firm*—Dennison, Meserole, Pollack & Scheiner

[57] ABSTRACT

It has been found that in heating pads for seats, preferably car-seats, in which the heating pad (1 and 2) covers both seat and back-rest, an energy recoil from the back-rest may occur. The invention reduces said recoil by dimensioning the resistance wire (11) in the section (4 and 6) of the heating pad (1 and 2) covering the seat and of the resistance wire (10) in the section (3 and 5) of the heating pad (1 and 2) covering the back-rest in such a way that the ratio between the resistance of the first-mentioned resistance wire (11) and that of the last-mentioned resistance wire (10) increases when current flows through.

5 Claims, 3 Drawing Figures

ELECTRIC HEATING PAD FOR SEATS AND BACK-RESTS

The present invention relates to electrical means in heating pads. Such pads are used for seats in vehicles, in the cabins of various public and industrial transport means. A heating pad may be placed loose on the seat or it may be built in to the back and seat of the chair itself. If a loose heating pad is used it consists of one section for the seat and one for the back-rest. In the case of built-in heating pads, too, there is one heating-wire loop for the seat and one for the back-rest. The heating-wire loops for seat and back-rest are normally connected in series. The series-connected heating wires cooperate with each other by means of a thermostat which connects and disconnects the current to the two heating loops. It has been found that when the current is disconnected a rather unpleasant phenomenon occurs in which there is a recoil of energy from the back-rest to the person using the seat with heating pad. The back of a user is extremely sensitive and such a recoil of energy is therefore injurious since, for instance, the blood vessels in the back may expand, so that the user may catch cold, particularly if he goes directly out into a cold atmosphere with an over-heated back.

The object of the present invention is to reduce to a minimum the possibility of an energy recoil from the back of the seat when the current is disconnected from the heating-wire loop in the back-rest. According to the invention, this is in practice solved in that the ratio between the resistance in the heating wire in the section of the heating pad located in the seat and the resistance in the heating wire located in the back-rest increases when current flows through. The total resistance in the section of the heating pad located in the seat shall thus be greater than the resistance in that part which is located in the back-rest.

It is also possible according to the invention to use a wire in the part of the heating pad located in the seat which has such properties that the resistance increases when a current flows through it, and at the same time use a heating wire in the pad located in the back-rest which has such material properties that its resistance remains constant or alters more slowly at increased temperature, e.g. thicker copper wire which does not acquire such a high temperature as the wire in the seat.

Further characterics of the present invention are revealed in the following claims.

Figure 1:
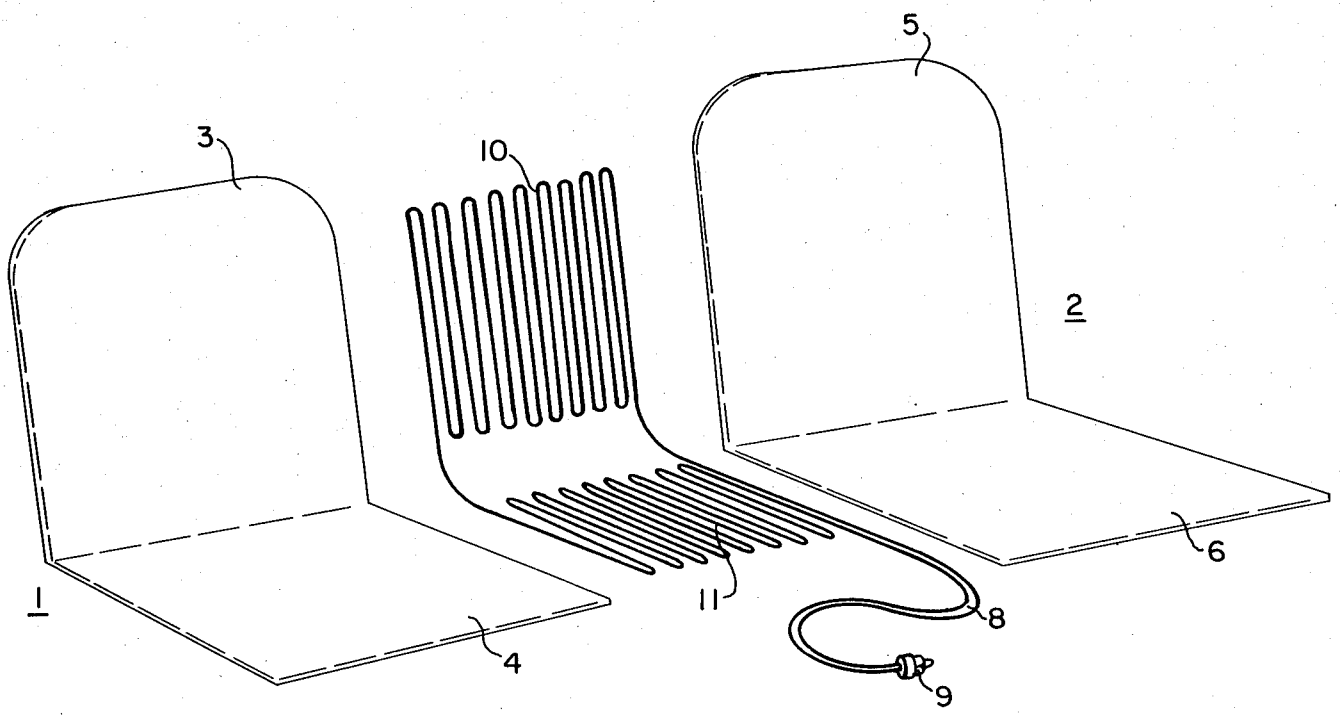
Figure 2:
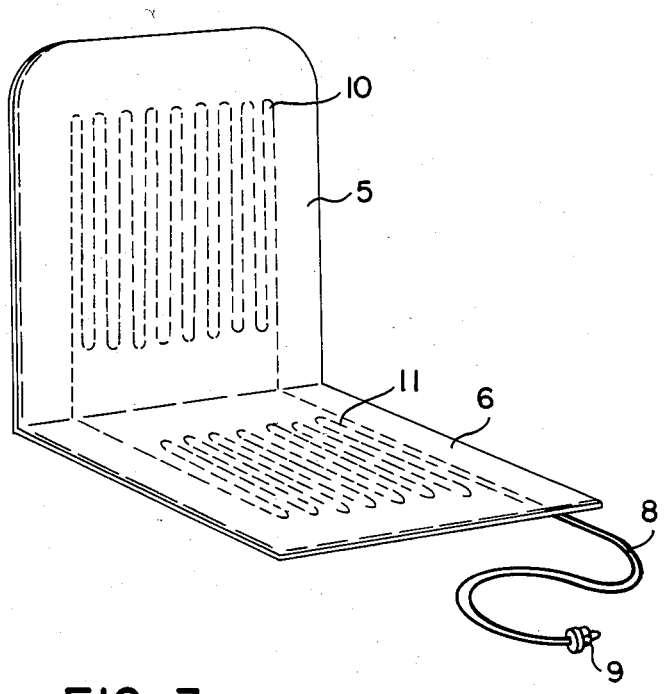

The invention will be described further with reference to the accompanying two drawings in which FIG. 1 shows in an exploded perspective the three parts forming a heating pad, and FIG. 2 shows the heating pad when assembled in perspective.

Figure 3:
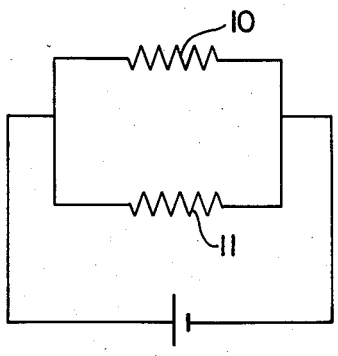

FIG. 3 is an electrical schematic of a modified form of my invention.

In the drawings 1 is the bottom part of a heating pad, consisting of a seat section and a back-rest. The back-rest is designated 3 and the seat section 4. The bottom part may be of any suitably material. Foam plastic or woven fabric is preferably used. An top part 2 is also shown, consisting of a seat section 6 and a back-rest 5. The material in the top part 2 may be of the same type as the bottom part 1. An electrical heating unit 7 is placed between the bottom and top parts. The heating unit is formed by a wire arranged to provide two sections, a first section 11 for the seat and a second section 10 for the back-rest. The two sections are made from a single wire having a connection cable 8 and a plug-in contact 9. The wire in the two sections may be copper, for instance. The wire in section 10 is preferably thicker than that in section 11. The wire in section 10 may thus have a cross-sectional area of 0.24 $mm^2$ and the wire in section 11 a cross-sectional area of 0.16 $mm^2$. At room temperature, therefore, the wire in section 10 will have a resistance of ca. 0.8 ohm and at the same temperature, the wire in section 11 may have a resistance of 1.2 ohm. If the heating pad, assembled as shown in FIG. 2, is connected by contact 9 to a voltage source in a vehicle, the wire in the two sections 10 and 11 will be heated and as the temperature increases, less energy will be accumulated in the back-rest section of the heating pad. When the current is disconnected from the heating pad, it has been found that the "recoil" of energy from the back-rest is reduced by ca. 25% in comparison with if the section 10 had had a resistance wire of the same dimension as that in section 11. Despite this, the pad is quickly heated up. The energy-recoil effect is reduced substantially directly dependent upon the ratio of the resistance in section 10 to that in section 11.

Another way of reducing the energy recoil from the back-rest is to make the wire in section 3 of such material that its resistance remains unaltered irrespective of the temperature of the wire, whereas section 2 contains wire in which the resistance increases with increasing temperature. A suitable material for the wire in section 10 in the present case is constantan. If sections 10 and 11 are connected in parallel as shown in FIG. 3, it is advisable for the resistance in section 11 to be constant or less changeable than the resistance in section 10.

I claim:

1. In a heating pad for seats in vehicles, and the like, having a heated seating surface and back-rest to provide heat to a user's back and seat area, comprising, in combination:

(a) seat cushion means for covering a seat section and a back rest of a seat to be heated, and including a bottom part and an overlying top part each comprising a back portion and a seat portion and constructed of a relatively soft material having a conductivity which varies as a function of compression of the material, the back rest normally storing more heat than the seat section;

(b) electrical resistance seat section heater means disposed between the seat portion of the top part and the seat portion of the bottom part of the seat cushion means;

(c) electrical resistance back-rest heater means disposed between the back portion of the top part and the back portion of the bottom part of the seat cushion means, each of the heater means being electrically connected in series to the other of the heater means and selectively connectible to a voltage source;

the improvement wherein the electrical resistance seat section heater means comprises a first resistance wire section having a variation in resistance thereof which is directly proportional to temperature over a range of temperatures to which the first wire section is subjected and the electrical resistance back-rest heater means comprises a second resistance wire section having a substantially constant resistance over a range of temperatures to which the second wire section is subjected in order to reduce the amount of energy stored in the back rest.

2. An improvement as defined in claim 1, wherein the first resistance wire section has a predetermined first cross-sectional area, and the second resistance wire section has a second cross-sectional area greater than the first cross-sectional area.

3. An improvement as defined in claim 2, wherein the first cross-sectional area is about 0.16 $mm^2$, and the second cross-sectional area about 0.22 $mm^2$.

4. An improvement as defined in claim 2, wherein the first resistance wire section and the second resistance wire section are constructed from the same material.

5. An improvement as defined in claim 1, wherein the second resistance wire section is constructed from a material different from a material used to construct the first resistance wire section.

* * * * *